US010046873B2

(12) United States Patent
Razzaboni et al.

(10) Patent No.: US 10,046,873 B2
(45) Date of Patent: Aug. 14, 2018

(54) DEVICE FOR FILLING AND CLOSING BAGS FOR CONTAINING PAPER DOCUMENTS, SUCH AS BANKNOTES AND THE LIKE

(71) Applicant: CIMA S.p.A., Mirandola, MO (US)

(72) Inventors: Nicoletta Razzaboni, Mirandola (IT); Vittorio Razzaboni, Mirandola (IT)

(73) Assignee: CIMA S.P.A., Mirandola, MO (IT)

( * ) Notice: Subject to any disclaimer, the term of this patent is extended or adjusted under 35 U.S.C. 154(b) by 288 days.

(21) Appl. No.: 14/810,732

(22) Filed: Jul. 28, 2015

(65) Prior Publication Data

US 2016/0031574 A1 Feb. 4, 2016

(30) Foreign Application Priority Data

Jul. 29, 2014 (IT) ..... MI2014A001369

(51) Int. Cl.
*G07D 11/00* (2006.01)
*B65B 7/02* (2006.01)
(Continued)

(52) U.S. Cl.
CPC ..... *B65B 7/02* (2013.01); *B65B 5/106* (2013.01); *B65B 25/14* (2013.01); *B65B 35/02* (2013.01);
(Continued)

(58) Field of Classification Search
CPC ..... G07D 11/00; G07D 11/0009; G07D 11/0021; B65B 51/10; B65B 7/02; B65B 5/061; B65B 25/14; B65B 39/06; B65B 35/40; B65B 5/067; B65H 31/04; B65H 29/46; B65H 31/14; B65H 2405/311
(Continued)

(56) References Cited

U.S. PATENT DOCUMENTS 8,763,779 B2 * 7/2014 Nireki ..... G07F 7/04 194/206

FOREIGN PATENT DOCUMENTS

WO 2011/054502 5/2011
WO WO 2011054502 A1 * 5/2011 ..... B65B 25/14

OTHER PUBLICATIONS

Italian Search Report Issued in Italian Patent Application No. MI2014A001369 dated Jul. 29, 2014.

* cited by examiner

*Primary Examiner* — Hemant M Desai
*Assistant Examiner* — Mary Hibbert
(74) *Attorney, Agent, or Firm* — Jacobson Holman, PLLC.

(57) ABSTRACT

A device for filling and closing disposable bags for containing banknotes comprises an upper container for temporarily housing banknotes, provided with a bottom with an opening for the exit of the banknotes from the container, a piston for pushing the banknotes towards the opening on the bottom of the container, a bag made of flexible plastic film, intended to be filled with the banknotes temporarily housed in the container, a support for the bag containing the banknotes, vertically movable through controlled lowering means and placed below the container, sealing bars arranged between the upper container and the movable support, and an electromagnetic stop element that can be controlled to lock the movable support with respect to the sealing bars, said electromagnetic stop element consisting of an electromagnet applied to the movable support and of a fixed element made of ferromagnetic material, adapted to face the electromagnet in operative condition.

7 Claims, 6 Drawing Sheets

(51) Int. Cl.

| | |
|---|---|
| ***B65B 25/14*** | (2006.01) |
| ***B65B 35/50*** | (2006.01) |
| ***B65B 45/00*** | (2006.01) |
| ***B65B 51/14*** | (2006.01) |
| ***B65H 31/10*** | (2006.01) |
| ***B65B 5/10*** | (2006.01) |
| ***B65B 35/02*** | (2006.01) |
| ***B65B 67/12*** | (2006.01) |
| ***B65H 31/26*** | (2006.01) |
| ***B65H 29/46*** | (2006.01) |

(52) U.S. Cl.

CPC ..... *B65B 35/50* (2013.01); *B65B 45/00* (2013.01); *B65B 51/146* (2013.01); *B65B 67/1211* (2013.01); *B65H 29/46* (2013.01); *B65H 31/10* (2013.01); *B65H 31/26* (2013.01); *G07D 11/0009* (2013.01); *B65H 2402/64* (2013.01); *B65H 2405/111* (2013.01); *B65H 2405/311* (2013.01); *B65H 2701/182* (2013.01); *B65H 2701/1912* (2013.01)

(58) Field of Classification Search

USPC ..... 53/116, 117, 120, 528, 530, 540, 567, 53/570, 576, 577, 258; 271/180, 178, 271/220, 177, 181; 232/43.2, 43.3; 414/798.2

See application file for complete search history.

DEVICE FOR FILLING AND CLOSING BAGS FOR CONTAINING PAPER DOCUMENTS, SUCH AS BANKNOTES AND THE LIKE

BACKGROUND OF THE INVENTION

The present invention refers to a device for filling and closing disposable bags suitable for containing paper documents, in particular banknotes.

Such a device is intended to be used in machines for storing banknotes, normally present at banks, supermarkets, shopping centres or similar.

Devices of this type, characterised by a structure that comprises an upper container for temporarily housing one or more banknotes (provided with an opening on the bottom for the controlled exit of the banknotes) and a lower element with a plane for supporting the bag intended to be filled with the banknotes, placed below the opening in the bottom of the upper container, are described for example in Italian patent applications MI2013A000753 and MI2013A000751 to the same Applicant. The lower plane for supporting the bag containing the banknotes is vertically movable, against the action of compression or traction springs, so as to progressively lower as the number of banknotes that enter into the bag increases, due to the thickness of the banknotes.

In such devices, the controlled transfer of the banknotes from the upper container to the bag supported on the lower movable plane takes place thanks to the thrust of a vertically movable piston inside the upper container to push the banknotes downwards so as to force them to pass through the opening on the bottom of the container. Once the passage has occurred, and the banknotes have been introduced into the bag, the thrust of the piston contributes to lowering the lower movable plane.

Once the bag is filled, it is closed by means of a pair of sealing bars arranged between the bottom of the upper container and the lower movable plane, after having retracted the piston taking it back into its upper position so as not to interfere with the blades themselves.

Following the retraction of the piston, however, the force of the compression or traction springs (now only counteracted by the weight of the banknotes, but no longer by the thrust of the piston) causes the lower movable plane to lift until the banknotes rest (with the bag interposed) against the lower surface of plates or other appropriate protective elements of the sealing bars, which are usually provided to avoid direct contact between the bag and the bar moving mechanisms. In this situation, with the banknotes pressed (with interposition of the bag) against the aforementioned protective elements, the actuation of the sealing bars causes traction of the bag, making it move in the area adjacent to the bars themselves.

This movement of the bag causes a movement of the banknotes present in the upper portion of the stack, which are in contact with the bag itself and immediately adjacent thereto.

Depending on the friction coefficient of the bag (thus based on the physical and mechanical properties of the bag), the behaviour of the banknotes can be different. For example, if the bags have a low friction coefficient and are not very rigid, the displacement of the banknotes due to the movement of the sealing bars can be minimal and thus negligible.

On the contrary, in the case of bags with a high friction coefficient, or with a greater degree of rigidity, the movement of the sealing bars can produce a significant displacement of the banknotes, which tend to move as a whole with the bars themselves. In this case, the banknotes can become pressed between the bars or, in the worst case, even come out from the bag. It is clear that in these cases a correct sealing of the bag cannot be obtained because a banknote is interposed between the bars, thus preventing the two edges of the bag from being joined.

In order to avoid this problem, the action of the springs pushing the lower movable plane for supporting the bag must be annulled during the sealing process and, at the same time, the banknotes must be kept spaced from the protective plates of the sealing bars, so that the bars can advance without the banknotes moving together with the bag, which, on the other hand, is free to move together with the bars.

In the prior art, solutions to prevent the movement of the lower movable plane can provide for the use of electric motors, clutches, solenoids, etc. All of these solutions, however, involve remarkable mechanical or electronic complexity. For example, the application and use of an electric motor or of a clutch require a lot of space and their management can prove complex and difficult, both for effective control of the actuation steps, and to obtain adequate precision in the positioning of the support plane.

The use of a solenoid, on the other hand, can cause problems connected with the reliability of maintaining the support plane in locked position, which is continuously strained by the action of the pushing spring.

BRIEF SUMMARY OF THE INVENTION

The general purpose of the present invention is to avoid the aforementioned drawbacks by providing a device for filling and closing bags for containing paper documents, such as banknotes and the like, in which it is possible, in a simple, cost-effective and reliable manner, to annul the upward thrust that the lower support plane of the bag normally receives from the contrast springs, before beginning the step of closing and sealing the bag, thus preventing the banknotes present in the upper portion of the bag from being pulled towards the mouth of the bag upon the actuation of the sealing bars.

In view of such a purpose it has been thought of to make, according to the invention, a device for filling and closing disposable bags for containing banknotes, comprising an upper container for temporarily housing one or more banknotes, provided with a bottom with an opening for the exit of said one or more banknotes from the container, a piston for pushing said one or more banknotes towards the opening on the bottom of the container, a bag made of flexible plastic film, intended to be filled with the banknotes temporarily housed in the container and come out through said opening, a support for the bag containing the banknotes, vertically movable through controlled lowering means and placed below the container, and sealing bars arranged between the upper container and the movable support and intended to seal the mouth of the bag once filling is complete, characterised in that it comprises an electromagnetic stop element that can be controlled to lock the movable support with respect to the sealing bars, said electromagnetic stop element consisting of an electromagnet applied to the movable support and a fixed element made of ferromagnetic material, adapted to face the electromagnet in operative condition.

BRIEF DESCRIPTION OF THE SEVERAL VIEWS OF THE DRAWING(S)

In order to make the explanation of the innovative principles of the present invention and its advantages with respect to the prior art clearer, hereafter, with the help of the attached drawings, we will describe a possible embodiment applying such principles. In the drawings.

DETAILED DESCRIPTION OF THE INVENTION

Figure 2:
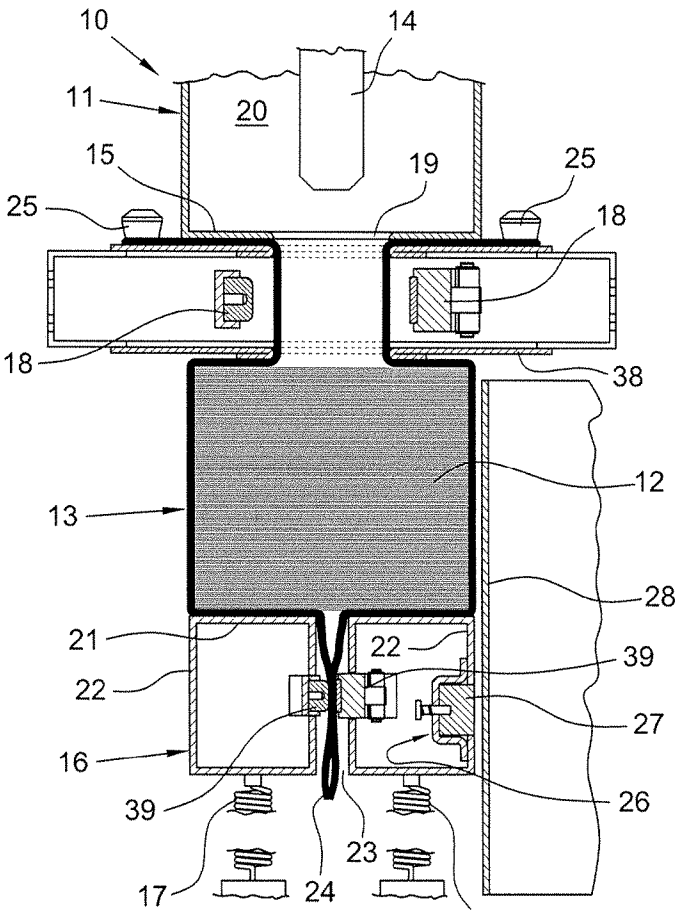
FIG. 2 represents a view of the device of FIG. 1 after all the banknotes have been introduced into the bag.

With reference to FIGS. 1-8, the device 10 for filling and closing bags for containing banknotes essentially consists of an upper container 11 in which the banknotes 12, intended to be introduced into a bag 13, are temporarily housed, of a piston 14 for pushing the banknotes towards the bottom 15 of the container 11, of a support 16 of the banknotes once inserted in the bag, which is placed below the container 11 and is vertically movable through controlled lowering means 17 (advantageously compression springs), and of sealing bars 18, arranged between the container 11 and the movable support 16 and intended to seal the mouth of the bag once filling is complete.

The bag 13 is advantageously of the disposable type, made of flexible plastic film.

The device is intended to be contained in known machines (not shown in the drawings attached hereto) for storing banknotes, normally present at banks, supermarkets, shopping centres or similar. For the sake of wording simplicity, reference is made here to banknotes, but the device according to the invention can equally be used for processing and handling other paper documents in sheet form.

The bottom 15 of the container 11 is provided with an opening 19, aligned with the piston 14, for the passage of the banknotes from the inner space 20 of the upper container 11 to the movable support 16. The opening 19 has a smaller passage section than the surface of the banknotes, so that the banknotes not pushed by the piston 14 are held in the inner space 20 of the container 11 by resting their peripheral portions at the sides of the opening 19.

The movable support 16 can advantageously have an upper plane 21 for resting of the stacked banknotes introduced into the bag, with interposition of the bag itself, and side walls 22 extending beneath said upper plane 21.

Figure 1:
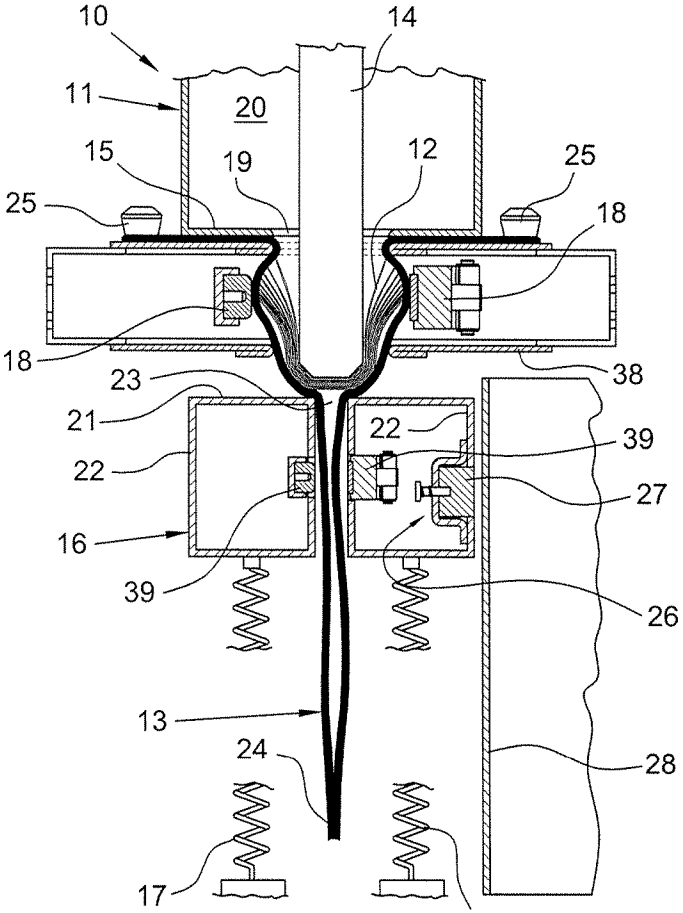
FIG. 1 illustrates a schematic, partially sectioned view of a device for filling and closing bags according to the invention, represented in an initial step of the bag filling operation.
Figure 4:
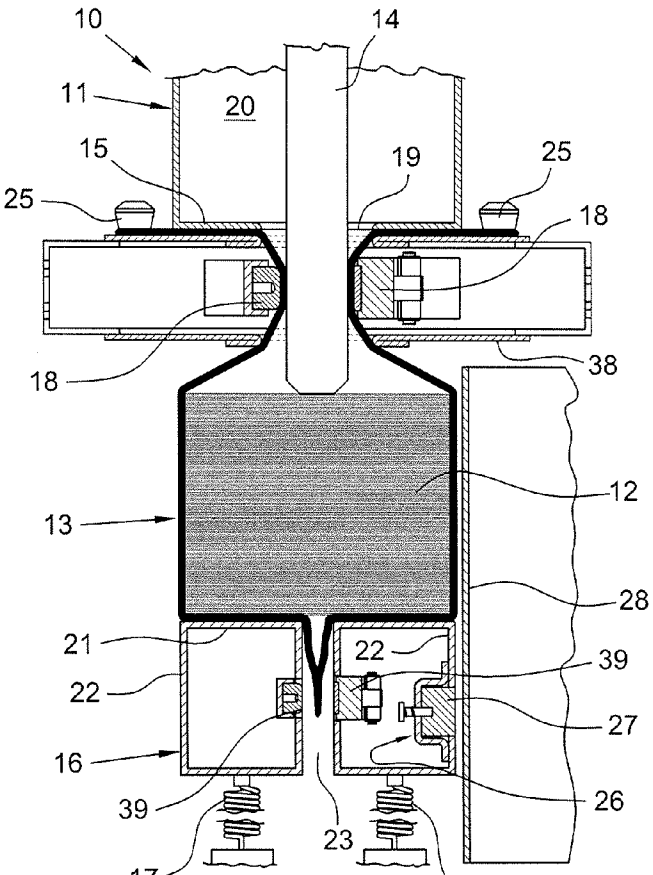
FIGS. 3-8 represent the device according to the invention in successive operative positions during the step of closing and sealing the bag.

In the embodiment illustrated in the figures, the movable support 16 has, at the upper plane 21, a central slot 23 open on top towards the container 11 and extending vertically through the body of the support 16, in which the empty bag, hung above at the container 11, is inserted with its "tail" 24 (i.e. the portion near its closed bottom) as can be seen in FIG. 1. Advantageously, the slot 23 is a through slot, also opening at the bottom to allow easy insertion of the bags irrespective of their length.

The bag 13 can, for example, be constrained with the edges of its mouth to fastening pins 25 arranged laterally to the container 11 in proximity of the opening 19 in its bottom 15. The bag, however, could also be supported by the container 11, wound outside of its side walls with a plurality of bends that constitute a reserve for the elongation and opening out of the bag during the successive steps of filling with the banknotes, progressively as the banknotes themselves are introduced into the bag and the lower support 16 lowers against the action of the springs 17.

According to the invention, the device 10 is provided with an electromagnetic stop element 26 for locking the movable support 16 of the banknotes with respect to the fixed structure of the machine and, in particular, with respect to the sealing bars.

Figure 9:
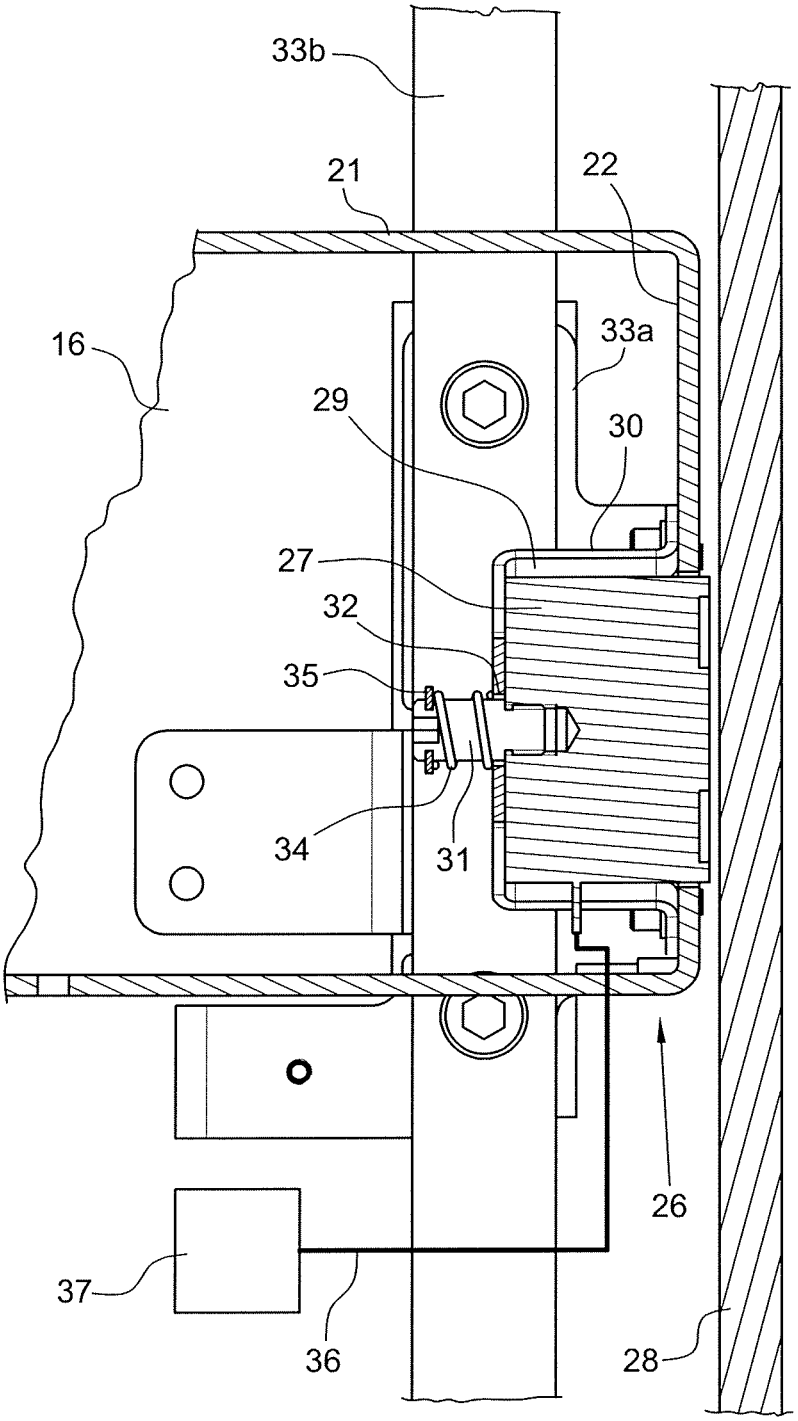
FIG. 9 shows a detailed view of the system for locking the banknote support plane in the device according to the invention, represented in non-operative condition.
Figure 10:
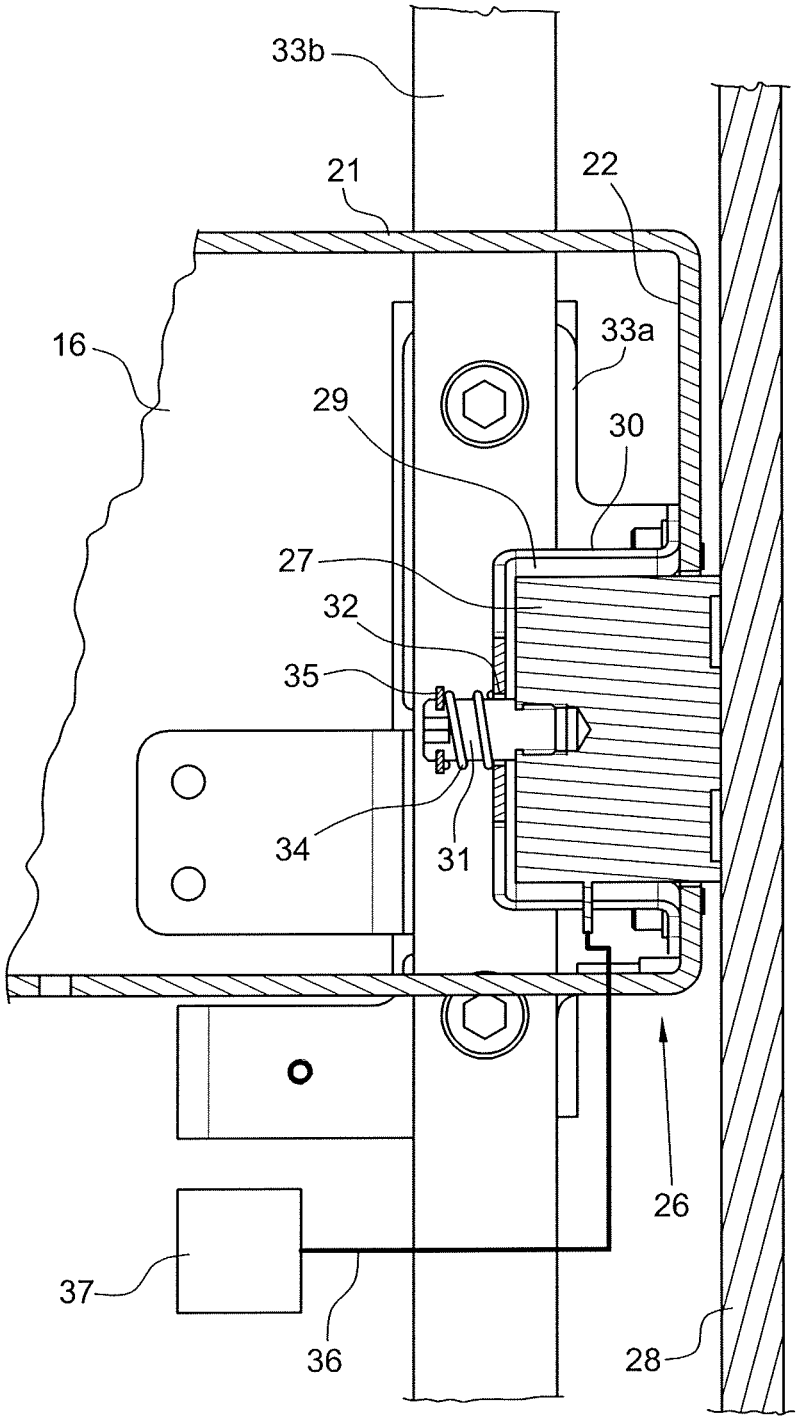
FIG. 10 shows a detailed view of the locking system of FIG. 9 in operative locking condition.

As can be seen in detail in FIGS. 9 and 10, the electromagnetic stop element 26 consists of an electromagnet 27 applied to the movable support 16 for the banknotes and of a fixed element 28 made of ferromagnetic material, adapted to face the electromagnet 27 in operative condition.

Advantageously, the ferromagnetic element 28 consists of a plane or a strip extending vertically along the section run by the movable element 16, as can be seen in the figures.

The electromagnet 27 is housed in a seat 29 defined by a bracket 30 fixed to the movable support 16 at a side wall 22 thereof. The seat 29 is open towards the outside of the movable support 16, in the direction of the plane made of ferromagnetic material 28.

The electromagnet 27 is fixed to the support 16 by means of a pin 31, passing through a hole 32 in the bracket 30, to be movable with respect to the support 16 in the direction of the plane made of ferromagnetic material 28.

In particular, according to the configuration illustrated here, the electromagnet 27 with its pin 31 are movable horizontally with respect to the bracket 30 and to the support 16 and fixedly connected, in the vertical direction, with respect to a slide 33*a* fixed to the support 16 and able to slide vertically in a guide 33*b* fixedly connected to the fixed frame of the machine (and, therefore, fixed with respect to the plane made of ferromagnetic material 28).

A compression spring 34 is arranged on the pin 31 between its head 35 and the surface of the bracket around the hole 32 to normally, in non operative condition, keep the electromagnet 27 retracted inside the seat 29 as shown in FIG. 9.

A suitable electrical connection 36 connects the electromagnet 27 with a control unit 37 to supply the electromagnet when it is required to lock the movable support 16 of the banknotes.

In particular, when it is required to lock the movable support 16 of the banknotes, the control unit 37 supplies electric power to the electromagnet 27. The magnetic field that is thus generated produces an attraction force between the electromagnet 27 and the fixed plane made of ferromagnetic material 28 facing the electromagnet. This force, being greater than the force of the contrast spring 34, causes a movement of the electromagnet 27 towards the fixed plane 28 as shown in FIG. 10.

In this operative condition the electromagnet 27 and the ferromagnetic plane 28 are mutually attracted by a force directed perpendicularly to the respective contact surfaces and, therefore, perpendicularly to the direction of vertical movement of the movable support 16 of the banknotes. The friction between the surfaces of the electromagnet and of the ferromagnetic plane consequently generates a locking force directed parallel to the surfaces themselves and thus parallel to the aforementioned direction of vertical movement of the movable support 16 of the banknotes.

The intensity of the excitation current of the electromagnet will of course be selected so that the locking force is greater than the force of the spring 17 that tends to lift the support 16 in any loading condition of the bag. In this way, the support 16, and in particular the plane 21 on which the bag containing the banknotes rests, can stay immobile in the desired position.

Once the electromagnet 27 has its power supply disconnected, the attraction force with the ferromagnetic plane 28 ceases and the spring 34 pulls the electromagnet back inside the seat 29, in the position of FIG. 9, and the support 16 is now again free to move vertically.

With the help of the attached figures, an operative sequence of loading of the banknotes in the bag and of closing the bag itself will now be briefly described.

In FIG. 1 the device for filling and closing bags according to the invention is illustrated at the moment when the piston 14 exerts a downward pressure on a bundle of banknotes 12, such as to push the banknotes themselves to insert with a central portion thereof in the opening 19 of the bottom 15 of the container 11 until they get in contact with the upper plane 21 of the movable support 16, with interposition of the plastic film that forms the bag. In this step the banknotes deform as illustrated in the figure to be able to come out from the container 11 through the opening 19 and the bag widens through the action of the thrust exerted by the banknotes.

After a plurality of operations like the one illustrated in FIG. 1, all the banknotes are entered into the bag 13 up to the desired capacity, supported by the plane 21 of the support 16 that meanwhile has lowered against the action of the pushing springs 17.

In the specific embodiment of the support 16 illustrated here, the widening of the bag, due to the increase in the number of banknotes contained in it, also causes a shortening thereof with respect to the original condition, which substantiates into a rising of its tail 24 both in absolute terms with respect to the fixed parts of the device, and in relative terms with respect to the movable support 16.

In this condition, the movable support 16 is pushed upwards by the springs 17 and the banknotes in the bag 13 are kept compacted between the plane 21 of the movable support 16 and the protective plates 38 of the sealing bars 18 (FIG. 2).

Figure 3:
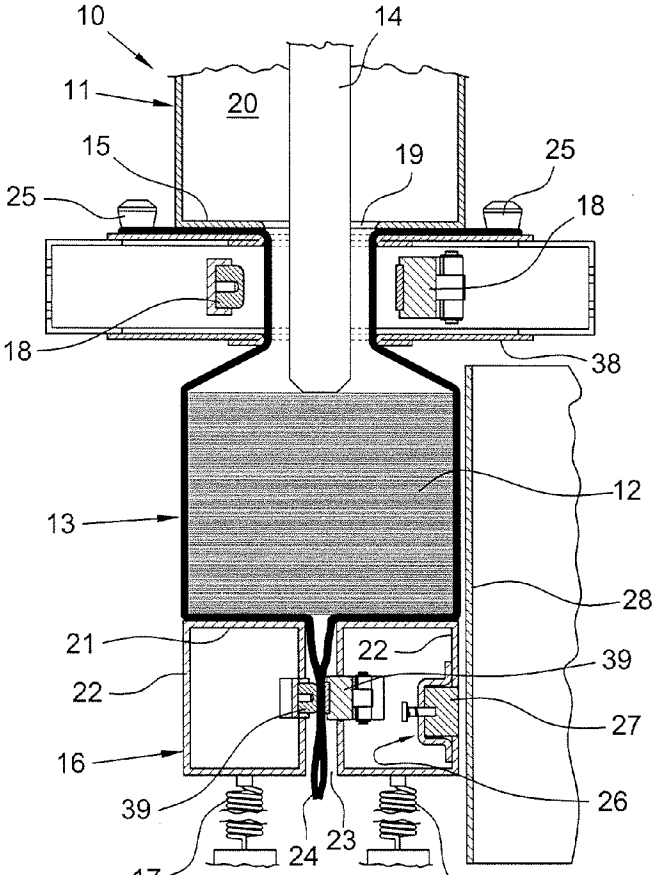
Figure 6:
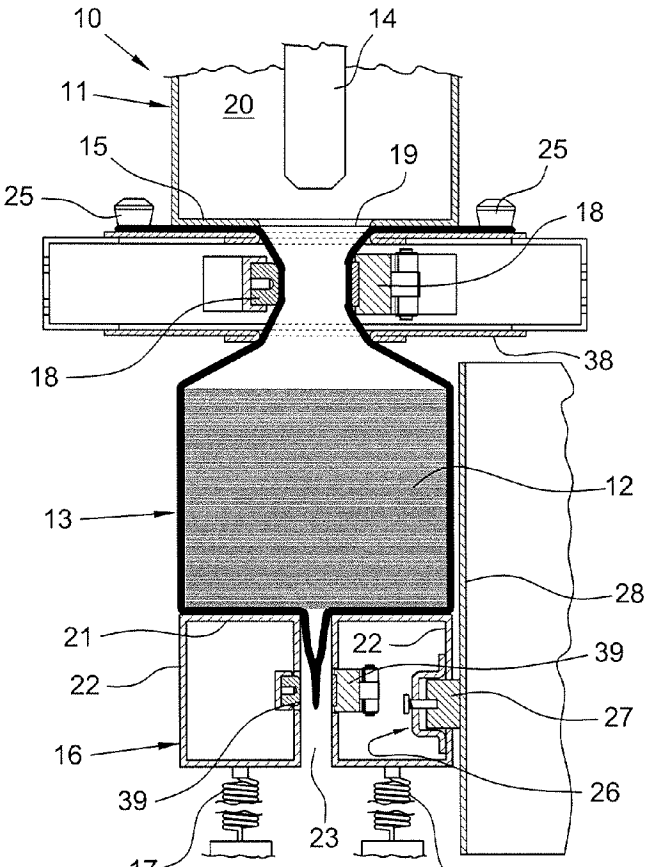

At this point, once the filling of the bag is completed, the closing step must begin. The piston 14 is lowered, as illustrated in FIG. 3, so as to take the banknotes away from the protective plates 38 of the sealing bars, with a corresponding lowering of the movable support 16 against the action of the springs 17.

Advantageously, a first partial advancing of the sealing bars can also be carried out (FIG. 4) so as to "recover" a little of the plastic material that forms the bag to decrease the tension of the film in the subsequent sealing step.

The movable support 16 is at a height that allows the banknotes in the upper portion of the bag to be sufficiently spaced from the protective plates of the sealing bars. The control unit 37 now supplies the electromagnet 27 through the electrical connection 36.

Figure 5:
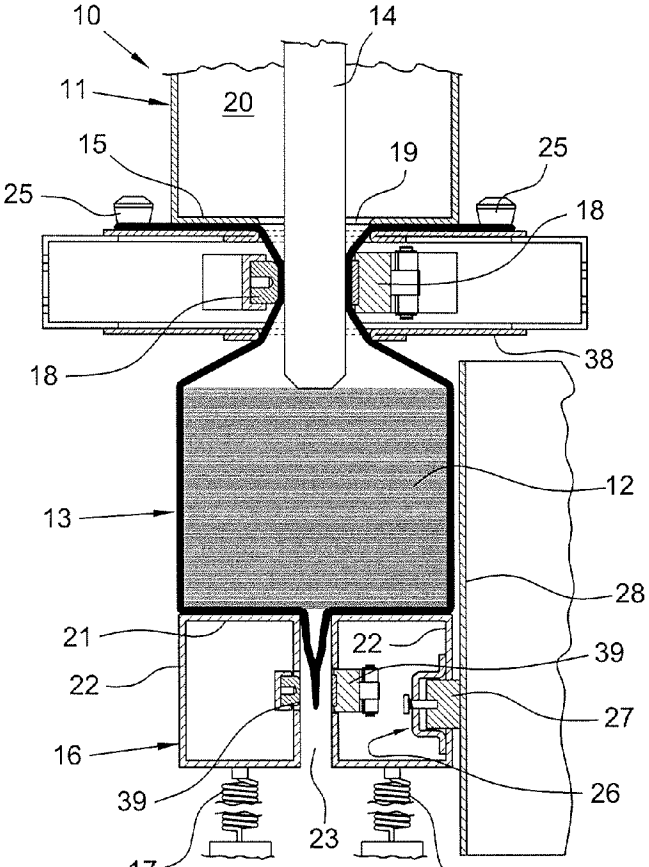
Figure 8:
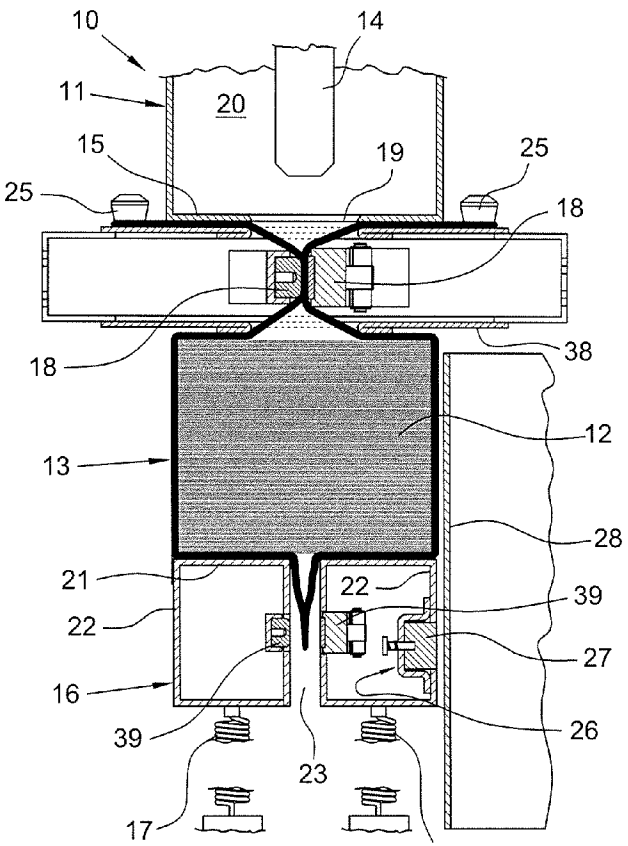

The magnetic field thus generated produces an attraction force between the electromagnet 27 and the fixed plane made of ferromagnetic material 28, causing a movement of the electromagnet, against the action of the contrast spring 34, towards the fixed plane 28 as shown in FIG. 5.

In this condition the movable support 16 is locked at the desired height and the piston 14 can be lifted (FIG. 6) to move away from the sealing area, still keeping the banknotes in the upper portion of the bag sufficiently spaced from the protective plates of the sealing bars.

Figure 7:
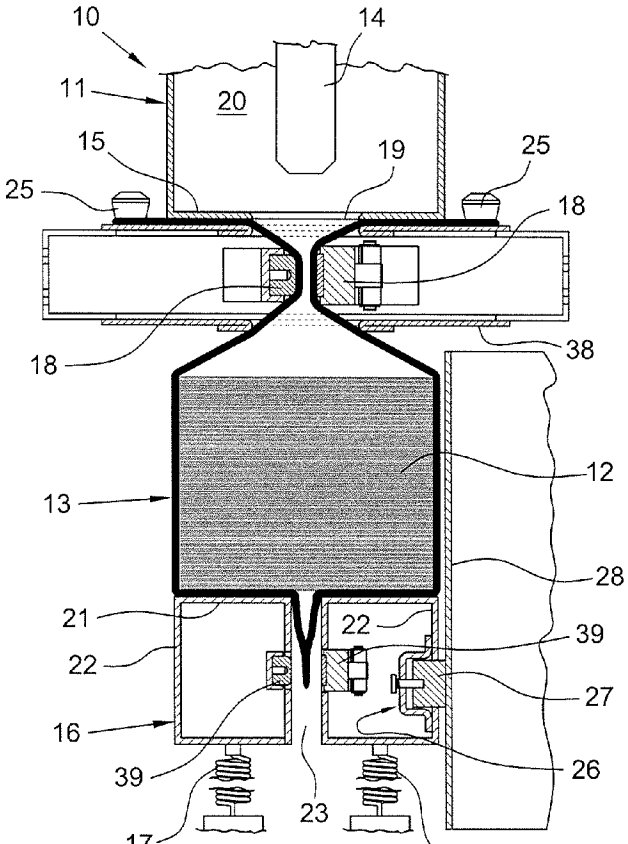

At this point the sealing bars 18 are partially closed (as illustrated in FIG. 7, leaving a distance apart of a few millimetres between the two bars), advantageously with alternation of partial advancements of the right bar and of the left bar so as to further "recover" a little of the plastic material that forms the bag, decreasing the strain of the film: carrying out the sealing of plastic bags having low thickness with the film too tight would indeed cause it to immediately break.

Thanks to the fact that the banknotes in the upper portion of the bag are spaced from the protective plates of the sealing bars, and also thanks to the provision of partially advancing the two bars alternately, the movement of the bars is prevented from pulling the upper banknotes between the bars or even making them come out of the top of the bag.

The electromagnet 27 can now have its power supply disconnected, so that the movable support 16 rises, compacting the banknotes in the bag against the protective plates 38 (FIG. 8), while the sealing bars 18 are completely closed and electrically supplied to carry out the definitive sealing of the bag.

At this point it is clear how the device for filling and closing bags according to the invention is capable of achieving the preset purposes. At least partially closing the sealing bars while keeping the banknotes in the upper portion of the bag spaced from the protective plates of the sealing bars, indeed, effectively makes it possible to avoid the first banknotes of the stack being pulled between the bars themselves by their advancing movement.

The use of an electromagnetic stop element to lock the support plane of the banknotes in the bag at the desired height before closing the sealing bars makes it possible to obtain this functionality of the machine in a simple, cost-effective and reliable manner, without expensive and cumbersome moving mechanical parts, and makes it possible to obtain a completely automated management of the various steps of the filling and closing process of the bag, directly by the control unit.

Of course, the above description of an embodiment applying the innovative principles of the present invention is given only as an example of such innovative principles and therefore it should not be taken to limit the scope of protection claimed here.

For example, if so desired, the device can have further sealing elements 39, arranged below at the slot 23 in the body of the movable support 16, to carry out sealing in proximity of the tail 24 of the bag in order to optimise the internal space available for the introduction of the banknotes. The actuation of these further sealing elements can take place at a suitable moment of the filling process of the bag. For example, in the illustrated figures, the actuation of these sealing elements is shown in the step of FIG. 2.

Of course, it is also possible to envisage a simpler structure of the support means of the bag containing the banknotes, for example without the slot 23 or even with a simple upper support plane at the plane 21, directly pushed by the springs 17. In this case, the support plane could be equipped with a side wall or appendix that extends beneath it for supporting the electromagnet.

Finally, the springs 17, illustrated here as compression springs, could also be traction springs.

The invention claimed is:

1. A device for filling and closing disposable bags for containing banknotes, comprising an upper container for temporarily housing one or more banknotes, provided with a bottom with an opening for the exit of said one or more banknotes from the container, a piston for pushing said one or more banknotes towards the opening on the bottom of the container, a bag made of flexible plastic film, intended to be filled with the banknotes temporarily housed in the container and come out through said opening, a support for the bag containing the banknotes, vertically movable through controlled lowering means and placed below the container, and sealing bars arranged between the upper container and the movable support and intended to seal the mouth of the bag upon completing the filling, wherein the device further comprises an electromagnetic stop element which can be controlled to lock the movable support with respect to the sealing bars, said electromagnetic stop element consisting of an electromagnet applied to the movable support and a fixed element made of ferromagnetic material, adapted to face the electromagnet in operative condition;

wherein the fixed element made of ferromagnetic material is made of a plane extended vertically along the section run by the movable element during the controlled lowering thereof;

wherein the electromagnet is housed is a seat in the movable support at a side wall thereof, said seat being open towards the outside of the movable support in the direction of the plane made of ferromagnetic material; and wherein the seat for housing the electromagnet is defined by bracket fixed to the movable support at said wall and in that the electromagnet is fixed to the movable support by a pin, passing through a hole in the bracket, to be movable with respect to the support in the direction of the plane made of ferromagnetic material.

2. The device according to claim 1, wherein the electromagnet is movable with respect to the support against the action of a compression spring arranged on the pin between a head of the pin and the surface of the bracket around the hole for normally maintaining the electromagnet retracted within said seat in non-operating condition.

3. The device according to claim 2, wherein the electromagnet is electrically connected to a control unit, so that the power supply of the electromagnet generates a magnetic field adapted to produce an attraction force between the electromagnet and the plane made of ferromagnetic material faced thereto, such as to move the electromagnet towards the outside of the seat against the action of said spring.

4. The device according to claim 1, wherein the actuation of the electromagnetic stop element is controllable before the actuation of the sealing bars for sealing the bag.

5. The device according to claim 1, wherein the vertically movable support has an upper plane for supporting the bag containing the banknotes, provided with a central slot open at the top towards the container and extended vertically through the body of the support for the insertion of a tail portion of the bag.

6. The device according to claim 5, wherein it comprises further sealing elements, arranged at the lower part at said slot in the body of the movable support to obtain a sealing in proximity of said tail portion of the bag.

7. The device according to claim 1, wherein said controlled lowering means consist of compression or traction springs.

* * * * *